US006684843B1

(12) United States Patent
Yoshida et al.

(10) Patent No.: US 6,684,843 B1
(45) Date of Patent: Feb. 3, 2004

(54) ENGINE

(75) Inventors: Hiroyuki Yoshida, Wako (JP); Hiroki Tawa, Wako (JP); Tamotsu Momosaki, Wako (JP); Hideaki Takada, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/088,083

(22) PCT Filed: Sep. 22, 2000

(86) PCT No.: PCT/JP00/06532

§ 371 (c)(1),
(2), (4) Date: Mar. 21, 2002

(87) PCT Pub. No.: WO01/21946

PCT Pub. Date: Mar. 29, 2001

(30) Foreign Application Priority Data

Sep. 24, 1999 (JP) ..... 11-270878

(51) Int. Cl.[7] ..... F02B 67/00

(52) U.S. Cl. ..... 123/185.2; 123/185.3; 123/195 C

(58) Field of Search ..... 123/149 D, 185.2, 123/185.3, 195 C

(56) References Cited

U.S. PATENT DOCUMENTS 3,747,649 A * 7/1973 Densow et al. ..... 123/149 D
3,782,355 A * 1/1974 Hamman ..... 123/185.2
3,871,350 A * 3/1975 Hamman ..... 123/185.2
4,019,490 A * 4/1977 Reese ..... 123/185.2
5,163,393 A * 11/1992 Naslund ..... 123/185.3
5,947,075 A * 9/1999 Ryu et al. ..... 123/185.3
6,213,078 B1 * 4/2001 Ryu et al. ..... 123/185.3
6,213,081 B1 * 4/2001 Ryu et al. ..... 123/185.3

FOREIGN PATENT DOCUMENTS

JP 2-54368 4/1990
JP 4-362231 12/1992
JP 9-177892 7/1997

* cited by examiner

*Primary Examiner*—Henry C. Yuen
*Assistant Examiner*—Jason Benton
(74) *Attorney, Agent, or Firm*—Arent Fox Kintner Plotkin & Kahn

(57) ABSTRACT

In an engine, a cover member closing an opening in an engine block is integrally formed with supporting arms extending radially outwards beyond an outer periphery of a flywheel mounted on a crankshaft supported at its one end on the cover member, and a recoil starter located axially outside the flywheel is supported on the supporting arms. Thus, the recoils starter can be supported easily and reliably without provision of a special mounting bracket and a stay and while preventing the interference with the flywheel. Moreover, the coaxiality of the recoil starter and the crankshaft can be ensured.

4 Claims, 6 Drawing Sheets

ENGINE

FIELD OF THE INVENTION

The present invention relates to an engine in which an auxiliary can easily be supported axially outside a flywheel mounted at an end of a crankshaft.

BACKGROUND ART

In general, an engine block forming a body of an engine is bisected into a cylinder block and a crankcase on a parting plane including an axis of a crankshaft. The crankshaft is supported so as to be sandwiched between the cylinder block and the crankcase.

In addition, in a single-cylinder vertical engine described in Japanese Patent Application Laid-open No. 4-362231, an engine body is comprised of an engine block integrally provided with a cylinder bore and a crankcase, and an upper cover closing an opening in an upper surface of the engine block. A lower journal of the crankshaft is supported in a bearing bore provided in the engine block, and an upper journal of the crankshaft is supported in a bearing bore provided in the upper cover.

In the former engine (the engine having the parting plane including the axis of the crankshaft), when a flywheel is mounted at an end of the crankshaft and further, an auxiliary such as a recoil starter is disposed axially outside the crankshaft, it is necessary to commonly work the cylinder block and the crankcase as a coupled member, and moreover, a part such as a mounting bracket is specially required to prevent an axis of the auxiliary and an axis of the crankshaft from being deviated from each other, resulting in increases in number of parts and number of assembling steps.

Further, in the latter engine (the engine including the cover member having the bearing bore defined in one end, and the engine block having the bearing bore defined in the other end), a mounting support portion is formed to extend from the side of an auxiliary beyond the flywheel toward the cover member coupled into a large opening in the engine block. As a result, the size of the cover member cannot be reduced to a level smaller than an area defined by a coupled portion of the auxiliary, and the opening in the engine block is also increased in size. This is a factor of hindrance of reductions in size and weight of the engine.

DISCLOSURE OF THE INVENTION

The present invention has been accomplished with the above circumstances in view, and it is an object of the present invention to ensure that the auxiliary can easily and reliably be supported axially outside the flywheel mounted on the crankshaft.

To achieve the above object, according to the present invention, there is proposed an engine comprising a crankshaft having a flywheel at one end thereof, an engine block including a cylinder bore and a crankcase and supporting a journal at the other end of the crankshaft, and a cover member coupled to the engine block to close an opening in the engine block and supporting a journal at the one end of the crankshaft, characterized in that the cover member has auxiliary-supporting portions integrally formed thereon to extend radially outwards beyond an outer periphery of the flywheel, and an auxiliary located axially outside the flywheel is supported on the auxiliary-supporting portions.

With the above arrangement, the auxiliary-supporting portions are integrally formed on the cover member closing the opening in the engine block to extend radially outwards beyond the outer periphery of the flywheel mounted to the crankshaft supported at one end thereof on the cover member, and the auxiliary located axially outside the flywheel is supported on the auxiliary-supporting portions. Therefore, the auxiliary can be supported easily and reliably without provision of a special mounting bracket and a stay, while preventing the interference with the flywheel. A coupled portion of the cover member in the opening in the engine block is not influenced or less influenced by the disposition of a mounting portion of the auxiliary. As a result, the opening in the engine block can be reduced in size to reduce the size and weight of the engine block.

In addition to the above arrangement, there is proposed an engine, wherein the auxiliary is a recoil starter coaxially connected to the one end of the crankshaft.

With such arrangement, the recoil starter is supported on the auxiliary-supporting portions integrally formed on the cover member supporting the one end of the crankshaft and hence, the recoil starter can be disposed precisely on an axis of the crankshaft.

Meanwhile, a rotor 78 in an embodiment corresponds to the flywheel in the present invention; recoil starter-supporting arms $\mathbf{71}_2$, $\mathbf{71}_3$, $\mathbf{71}_3$ in the embodiment correspond to the auxiliary-supporting portions in the present invention; and a recoil starter 18 in the embodiment corresponds to the auxiliary in the present invention.

In addition to the above arrangement, there is proposed an engine, wherein the engine block has an assembling bore for assembling a larger end of a connecting rod at a location opposed to the cylinder bore.

With the above arrangement, an operation for assembling the larger end of the connecting rod can be conducted through the assembling bore defined in the engine block. Therefore, it is unnecessary to enlarge the opening in the engine block in order to conduct the assembling operation, thereby contributing to a reduction in size of the engine block.

BEST MODE FOR CARRYING OUT THE INVENTION

The mode for carrying out the present invention will now be described by way of an embodiment shown in the accompanying drawings.

FIGS. 1 to 6 show an embodiment of the present invention.

Figure 1:
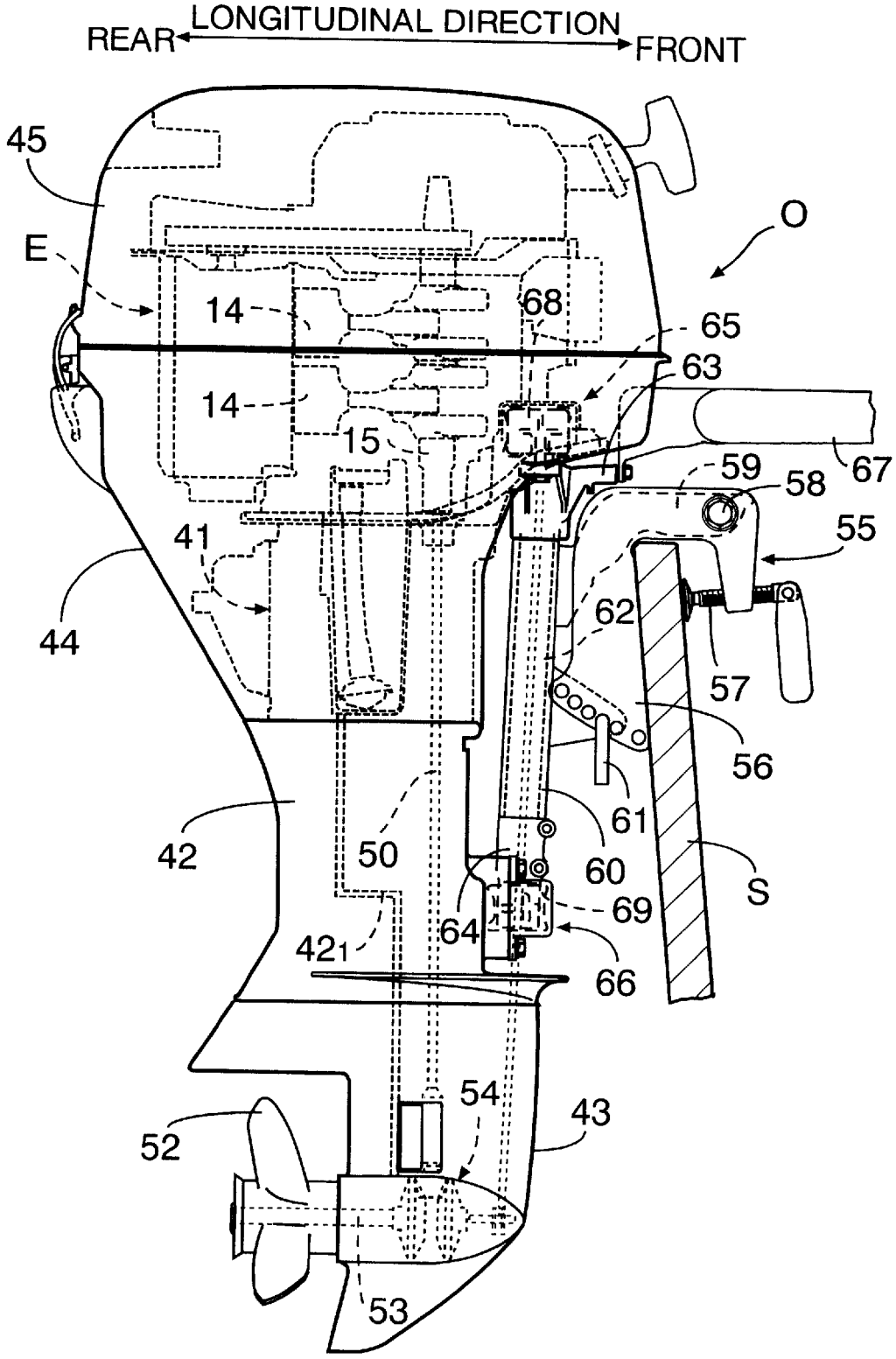
FIG. 1 is a side view of the entire arrangement of an outboard engine system.
Figure 2:
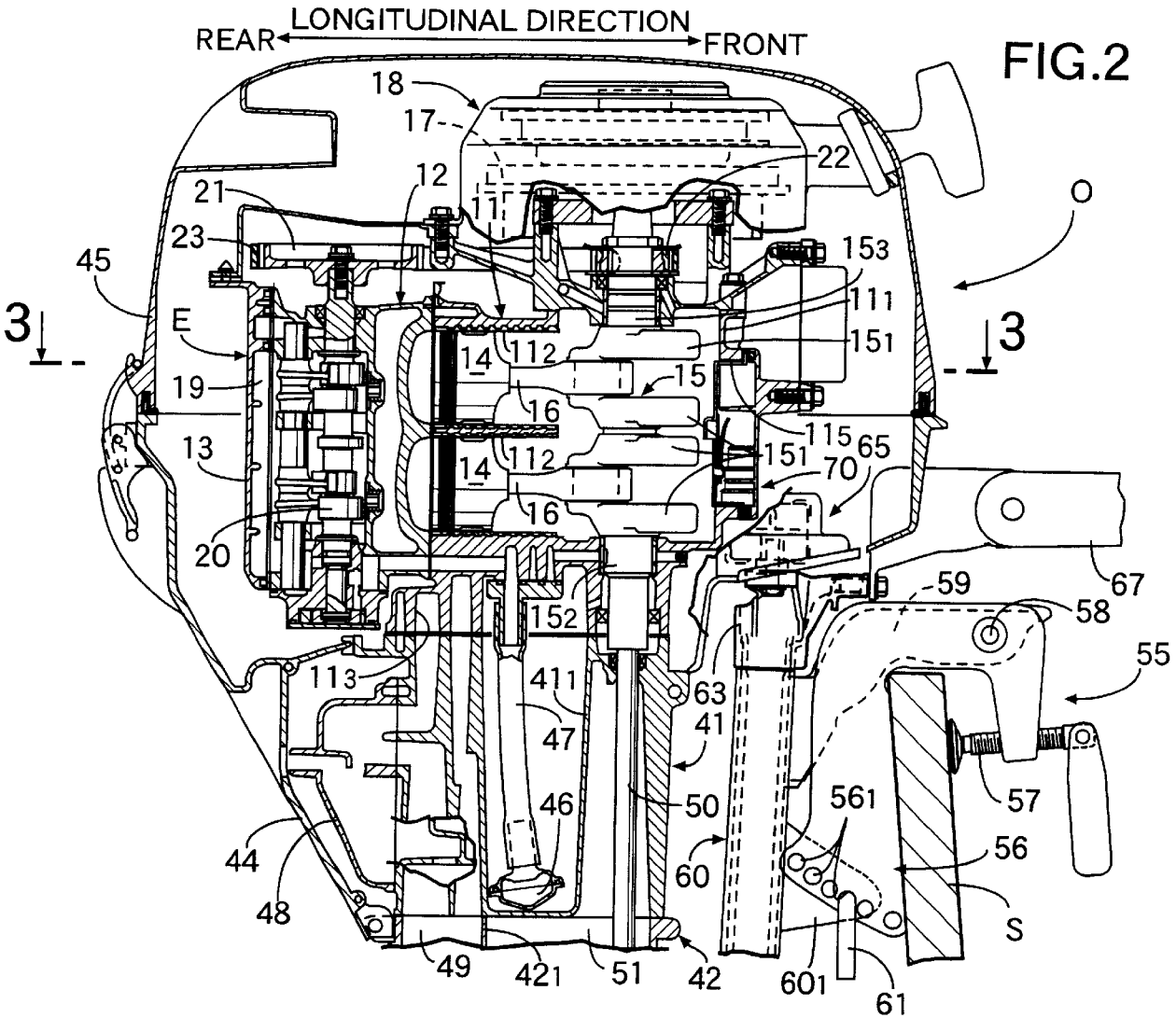
FIG. 2 is an enlarged sectional view of an essential portion shown in FIG. 1.
Figure 3:
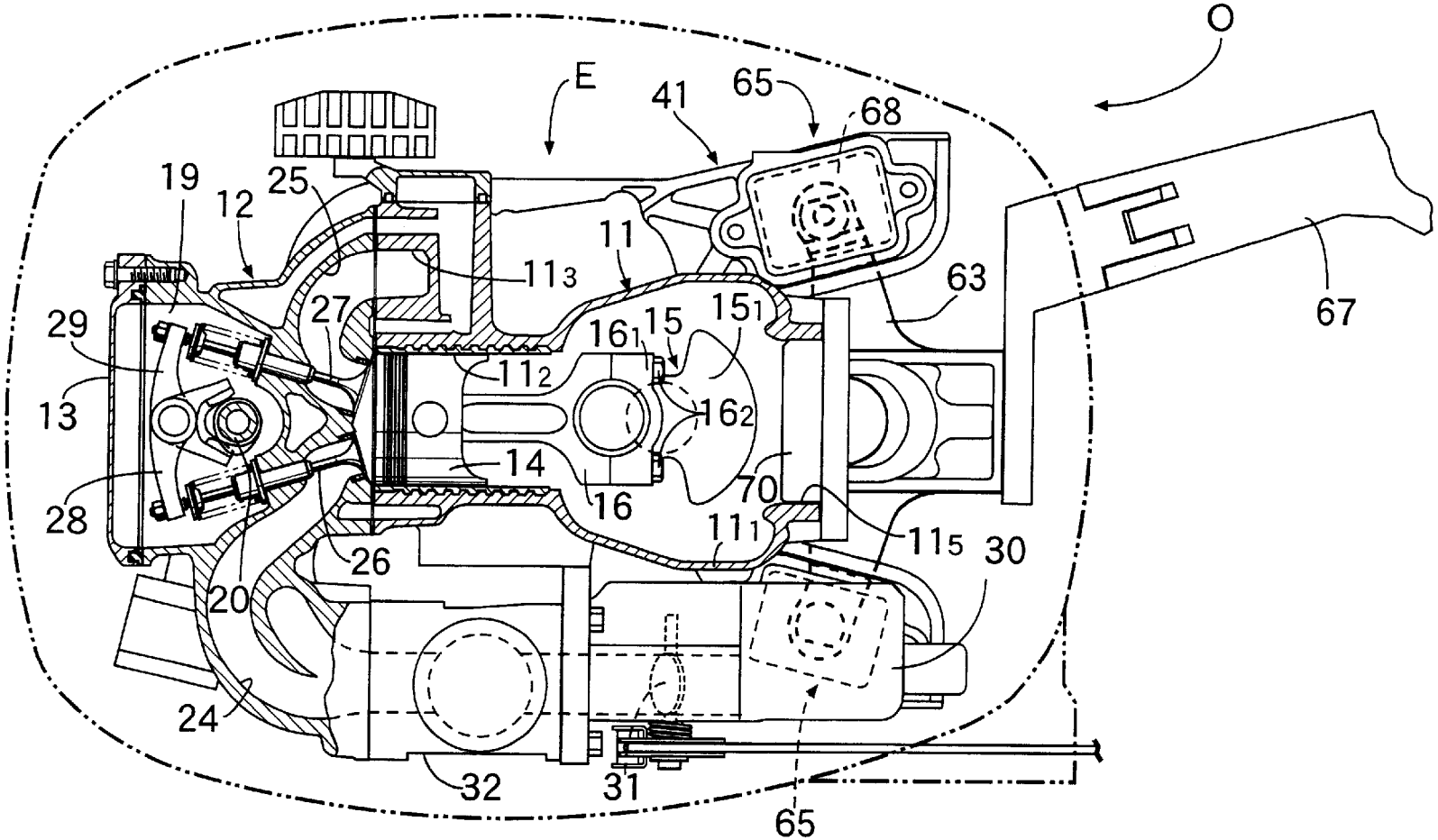
FIG. 3 is a sectional view taken along a line 3—3 in FIG. 2.

As shown in FIGS. 1 to 3, a two-cylinder and 4-cycle engine E mounted at an upper portion of an outboard engine system O includes an engine block 11 integrally provided with a crankcase $\mathbf{11}_1$, and two upper and lower cylinder bores $\mathbf{11}_2$, $\mathbf{11}_2$, a cylinder head 12 coupled to the engine block 11, and a head cover 13 coupled to the cylinder head 12. Two pistons 14, 14 slidably received in the two cylinder bores $\mathbf{11}_2$, $\mathbf{11}_2$ defined in the engine block 11 are connected through connecting rods 16, 16 to a crankshaft 15 supported in the engine block 11. Reference character $\mathbf{16}_2$ in FIG. 3 designates each of bolts for assembling bearing caps $\mathbf{16}_1$, $\mathbf{16}_1$, to larger ends of the connecting rods 16, 16.

A generator 17 and a recoil starter 18 are mounted coaxially on an end of the crankshaft 15 protruding upwards from the engine block 11. A camshaft 20 is supported in a valve-operating chamber 19 defined between the cylinder head 12 and the head cover 13, and a cam pulley 21 mounted at an upper end of the camshaft 20 and a crank pulley 22 mounted at an upper portion of the crankshaft 15 are connected to each other by a timing belt 23. An intake valve 26 and an exhaust valve 27 for opening and closing an intake port 24 and an exhaust port 25 defined in the cylinder head 12 respectively are connected to the camshaft 20 through an intake rocker arm 28 and an exhaust rocker arm 29, respectively. An intake silencer 30, a choke valve 31 and a variable Venturi-type carburetor 32 disposed on a right side of the engine E are connected to the intake port 24.

An axis of the crankshaft 15 is disposed vertically, and axes of the cylinder bores $\mathbf{11}_2$, $\mathbf{11}_2$ are disposed longitudinally of the outboard engine system O, so that a portion of each cylinder bore $\mathbf{11}_2$ on the side of the crankcase $\mathbf{11}_1$ faces forwards and a portion of each cylinder bore $\mathbf{11}_2$ on the side of the cylinder head 12 faces rearwards. The crank phases of the two pistons 14, 14 are the same as each other, and the ignition timings provided by the pistons 14, 14 are deviated from each other by 360°. Counterweights $\mathbf{15}_1$, having a balance rate of 100% for opposing the reciprocal movement mass of the pistons 14, 14 are mounted on the crankshaft 15.

An upper surface of an oil case 41 as an engine-supporting block which is integrally provided with an oil pan $\mathbf{41}_1$, is coupled to a lower surface of the engine E having the above-described structure. An upper surface of an extension case 42 is coupled to a lower surface of the oil case 41, and an upper surface of a gear case 43 is coupled to a lower surface of the extension case 42. An outer periphery of the oil case 41 and an outer periphery of a lower half of the engine E are covered with an undercover 44 coupled to an upper end of the extension case 42, and an upper half of the engine E is covered with an engine cover 45 coupled to an upper end of the undercover 44.

The oil case 41 is integrally provided with the oil pan $\mathbf{41}_1$, and a suction pipe 47 provided with an oil strainer 46 is accommodated in the oil pan $\mathbf{41}_1$. An exhaust passage-defining member 48 is coupled to a rear surface of the oil case 41, and an exhaust gas expansion chamber 49 is defined in the extension case 42 through a partition wall $\mathbf{42}_1$. An exhaust gas discharged from the exhaust port 25 is supplied through an exhaust passage $\mathbf{11}_3$ defined in the cylinder block 11 into the exhaust passage-defining member 48 and is discharged therefrom into the outside water via the exhaust gas expansion chamber 49 in the extension case 42, the inside of the gear case 43 and a space around a propeller shaft 53 described hereinafter.

A drive shaft 50 connected to a lower end of the crankshaft is passed through the oil case 41, extends downwards within a drive shaft chamber 51 defined in the extension case 42, and is connected through a forward/backward changeover mechanism 54 to a front end of the propeller shaft 53 which is provided at its rear end with a propeller 52 and supported longitudinally on the gear case 43.

A mounting bracket 55 for detachably mounting the outboard engine system O to a hull S includes an inverted J-shaped mounting bracket body 56 and a setscrew 57 threadedly engaged with the mounting bracket body 56. A swinging arm 59 is pivotally supported at its front end on the mounting bracket body 56 through a pivot pin 58, and a swivel case 60 having a vertically extending tubular portion is integrally coupled to a rear end of the swinging arm 59. A large number of pinholes $\mathbf{56}_1$, are provided in the mounting bracket body 56, so that the tilting angle of the outboard engine system O about the pivot pin 58 can be regulated by inserting a pin 61 through a pinhole made in a locking portion $\mathbf{60}_1$, fixed to the swivel case 60 and any one of the pinholes $\mathbf{56}_1$, in the mounting bracket body 56.

The outboard engine system O includes an upper mount 65 (an upper mounting portion) and a lower mount 66 (a lower mounting portion) at upper and lower ends of a swivel shaft 62 relatively rotatably fitted in the swivel case 60, respectively. The outboard engine system O is supported in an anti-vibration manner on the hull S by the upper and lower mounts 65 and 66.

More specifically, a rigid mount arm 63 is provided at the upper end of the swivel shaft 62 to extend laterally from the axial center, and upper mount rubber members 68, 68 which are an elastomeric members are mounted at left and right opposite ends of the mount arm 63. A rigid mount block 64 is provided at the lower end of the swivel shaft 62 to extend laterally from the axial center, and lower mount rubber members 69, 69 which are an elastomeric members are mounted at left and right opposite ends of the mount block 64. The oil case 41 as an engine-supporting block and the extension case 42 fastened to the oil case 41 are put into abutment against the upper mount rubber members 68, 68 and the lower mount rubber members 69, 69, whereby the outboard engine system O is supported in the anti-vibration manner on the hull S.

A steering handlebar 67 is fixed to a front end of the oil case 41 or the mount arm 63, so that the oil case 41 can be swung laterally about the swivel shaft 62 to steer the outboard engine system O by grasping the steering handlebar 67 to operate it laterally.

Figure 4:
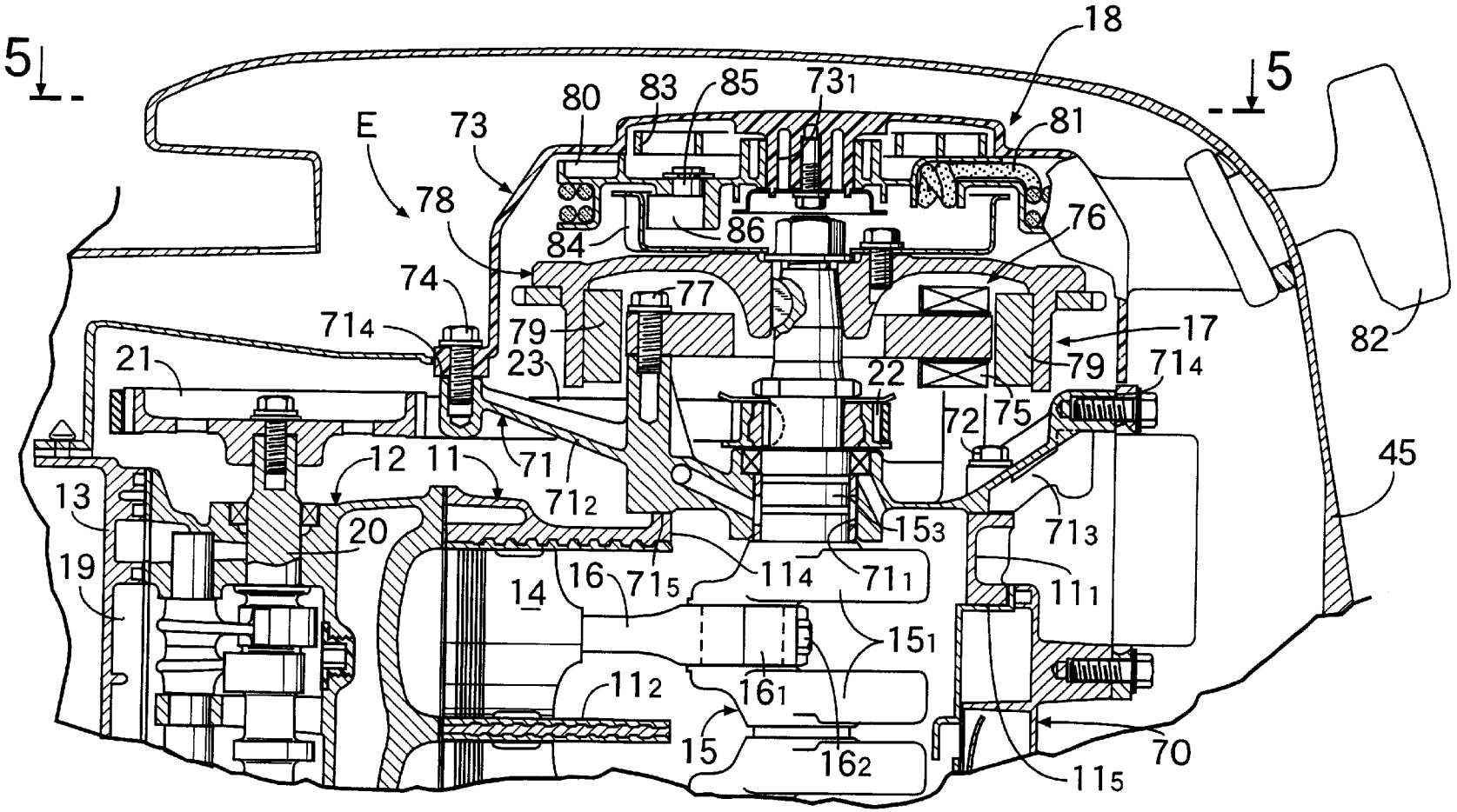
FIG. 4 is an enlarged view of the essential portion shown in FIG. 2.
Figure 5:
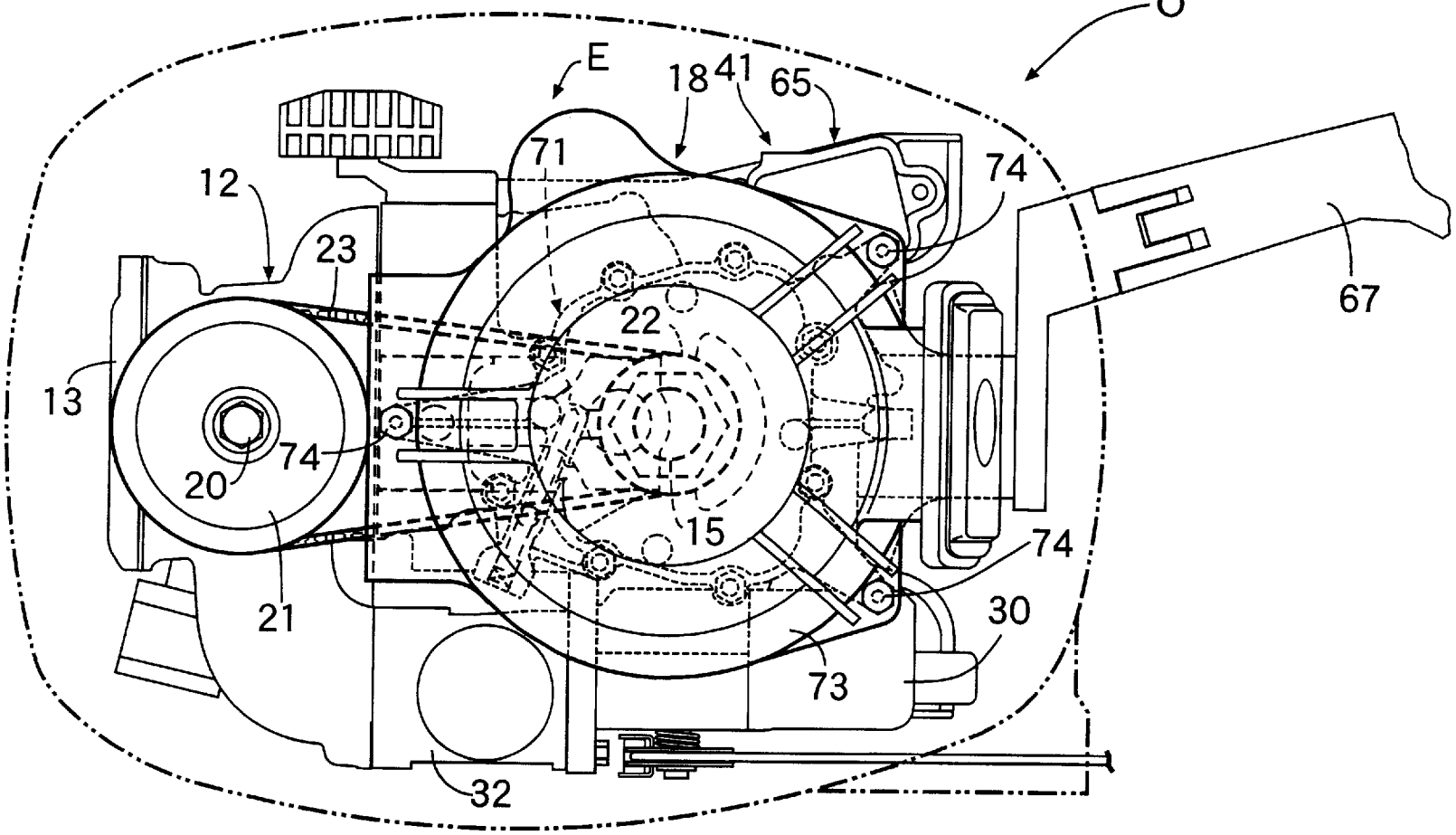
FIG. 5 is a view taken along a line 5—5 in FIG. 4.
Figure 6:
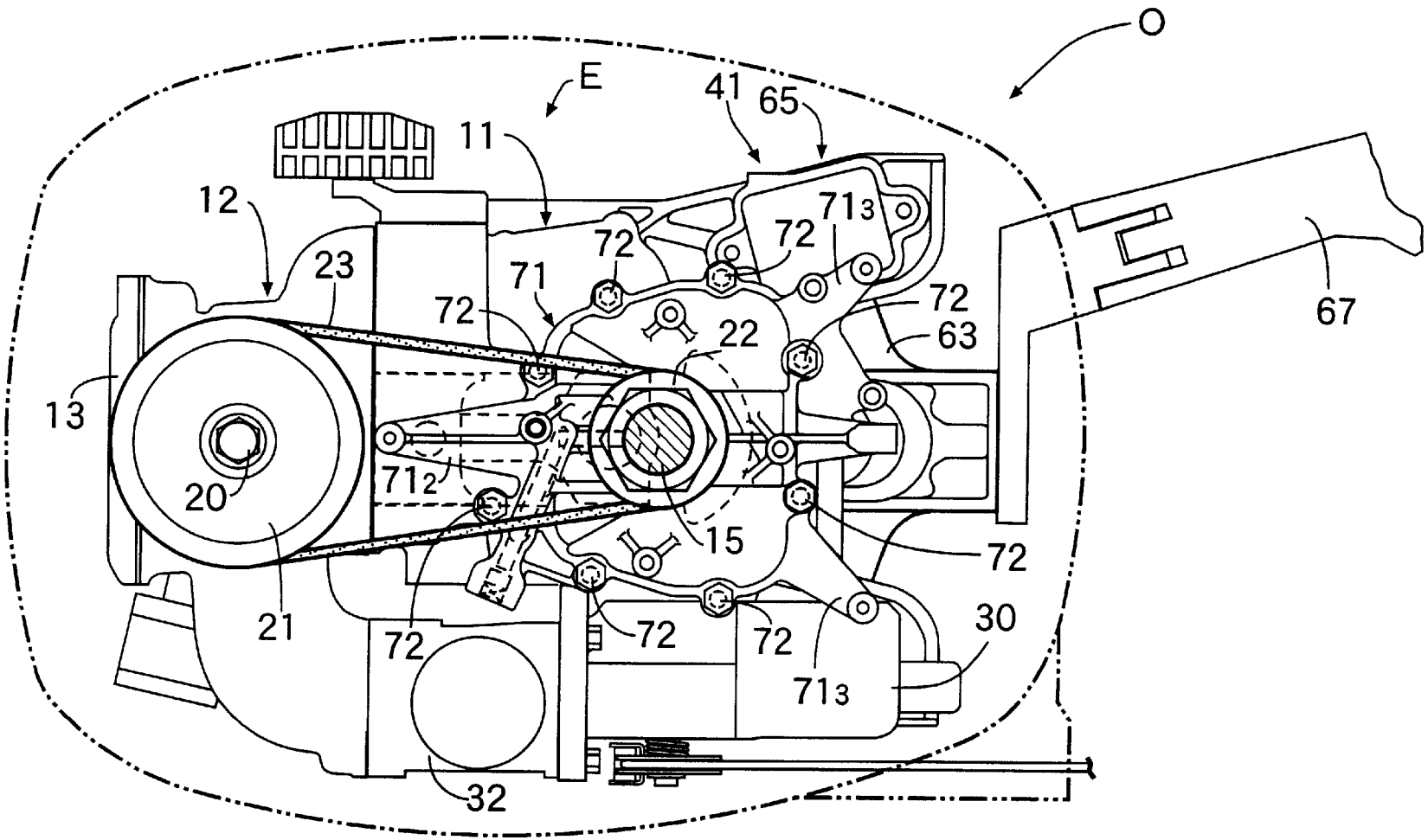
FIG. 6 is a view showing the outboard engine system with a recoil starter and a generator removed from FIG. 5.

As shown in FIGS. 4 to 6, a cover member 71 for covering an opening $\mathbf{11}_4$ (see FIG. 4) defined in an upper surface of the engine block 11 is fastened to the engine block 11 by eight bolts 72. A bearing bore $\mathbf{7}_1$, for supporting an upper journal $\mathbf{15}_3$ of the crankshaft 15 is defined in the cover member 71, and a starter cover 73 constituting a contour of the recoil starter 18 is fixed by three bolts 74 to tip ends of the three recoil starter supporting arms $\mathbf{71}_2$, $\mathbf{71}_3$, $\mathbf{71}_3$ extending radially outwards about the bearing bore $\mathbf{71}_1$. In FIG. 4, reference character $\mathbf{71}_4$ is an abutment of the cover member 71 against the starter cover 73, and reference character $\mathbf{71}_5$ is an abutment of the cover member 71 against the engine block 11. A lower journal $\mathbf{15}_2$ of the crankshaft 15 is supported on the engine block 11 (see FIG. 2).

As can be seen from FIGS. 3 and 4, the engine block 11 has an assembling bore $\mathbf{11}_5$ at a location opposed to the cylinder bores $\mathbf{11}_2$, $\mathbf{11}_2$. The assembling bore $\mathbf{11}_5$ is closed by a detachable breather device 70. An operation for assembling the larger ends of the connecting rods 16, 16 to the crankshaft 15 and fastening the bearing caps $\mathbf{16}_1$, $\mathbf{16}_1$ by bolts $\mathbf{16}_2$ can be conducted easily through the assembling bore $\mathbf{11}_5$ in the engine block 11.

The generator 17 disposed at the end of the crankshaft 15 extending upwards through the cover member 71 includes an annular stator 76 having coils 75 wound therearound. The stator 76 is fixed to an upper surface of the cover member 71 by four bolts 77 (see FIG. 4). A dish-shaped rotor 78 fixed to the end of the crankshaft 15 also serves as a flywheel, and includes permanent magnets 79 mounted on an inner surface of an outer periphery thereof and opposed to the coils 75 of the stator 76.

The recoil starter 18 disposed coaxially with the crankshaft 15 and the generator 17 includes a reel 80 rotatably supported on a boss $\mathbf{73}_1$, projectingly provided on an inner surface of the starter cover 73, and a knob 82 is mounted at a leading end of a rope 81 wound around the reel 80. When the rope 81 is pulled by the knob 82 to rotate the reel 80, a spiral spring 83 is resiliently deformed, and the reel 80 is reversed and returned to its original position by a restoring force of the spiral spring 83. A dish-shaped driven member 84 is fixed to an upper surface of the rotor 78 of the generator 17, and driving projections 86 pivotally supported on a lower surface of the reel 80 of the recoil starter 18 by a pin 85 is opposed for engagement to an inner peripheral surface of the driven member 84.

When the rope 81 is pulled to rotate the reel 80, the driving projections 86 swung radially outwards by a cam mechanism (not shown) are brought into engagement with the driven member 84, whereby the reel 80 cranks the crankshaft 15 through the rotor 78. When the reel 80 is returned to its original position by the repulsing force of the spiral spring 83, the driving projections 86 are swung radially inwards and disengaged from the driven member 84.

Among the three recoil starter supporting arms $\mathbf{71}_2$, $\mathbf{71}_3$, $\mathbf{71}_3$ of the cover member 71, the recoil starter supporting arm $\mathbf{71}_2$ extending rearwards is disposed within a loop of the timing belt 23 wound around the cam pulley 21 and the crank pulley 22 (see FIG. 6) and crosses a rotating surface of the timing belt 23 from blow to above (see FIG. 4). With such structure, the starter cover 73 can be supported on the recoil starter supporting arm $\mathbf{71}_2$ without interference with the timing belt 23.

Thus, since the recoil starter supporting arms $\mathbf{71}_2$, $\mathbf{71}_3$, $\mathbf{71}_3$ for supporting the recoil starter 18 are integrally formed on the cover member 71 closing the opening $\mathbf{11}_4$ in the engine block 11, it is unnecessary to provide a special mounting bracket and a stay for supporting the recoil starter 18 on the engine block 11 or another member, whereby increases in number of parts and in assembling steps can be inhibited. Moreover, the recoil starter supporting arms $\mathbf{71}_2$, $\mathbf{71}_3$, $\mathbf{71}_3$ protrude radially outwards beyond the outer periphery of the generator 17 disposed between the cover member 71 and:the recoil starter 18 and hence, the recoil starter 18 can be supported, while avoiding the interference with the generator 17.

Further, since the recoil starter supporting arms $\mathbf{71}_2$, $\mathbf{71}_3$, $\mathbf{71}_3$ are integrally formed on the cover member 71 supporting the upper journal $\mathbf{15}_3$ of the crankshaft 15, it is possible to easily ensure the coaxiality of the crankshaft 15 and the recoil starter 18 supported on recoil starter supporting arms $\mathbf{71}_2$, $\mathbf{71}_3$, $\mathbf{71}_3$, thereby guaranteeing the smooth operation of the recoil starter 18. In addition, since the starter cover 73 for the recoil starter 18 covers the generator 17 located below the starter cover 73, both of the recoil starter 18 and the generator 17 can be protected from a dust and water by the common starter cover 73.

Yet further, since the operation for assembling the larger ends of the connecting rods 16, 16 can be conducted through the assembling bore $\mathbf{11}_5$ defined in the engine block 11, it is unnecessary to conduct the assembling operation through the opening $\mathbf{11}_4$ provided in the upper portion in the engine block 11 and closed by the cover member 71. As a result, the size of the opening $\mathbf{11}_4$ may be determined in consideration of a locus of rotation of a web of the crankshaft 15, and a sidewall of the crankcase $\mathbf{11}_1$ can be located in proximity to the locus of rotation of the web of the crankshaft 15 to reduce the size of the engine block 11.

Although the embodiment of the present invention has been described in detail, it will be understood that various modifications in design may be made without departing from the subject matter of the invention.

For example, the engine E of the outboard engine system O has been illustrated in the embodiment, but the present invention is applicable to an engine used in any other application. In addition, the recoil starter 18 has been illustrated as an auxiliary in the embodiment, but the present invention is applicable to any other auxiliary.

INDUSTRIAL APPLICABILITY

As discussed above, the present invention is applicable to the outboard engine system including the cover member coupled to close the opening in the engine block and supporting the journal at one end of the crankshaft, and the flywheel fixed to one end of the crankshaft protruding from the cover member.

What is claimed is:

1. An engine comprising:

a crankshaft having a flywheel at one end thereof, an engine block including a cylinder bore and a crankcase and supporting a journal at the other end of the crankshaft, and a cover member coupled to said engine block to close an opening in said engine block and supporting a journal at the one end of the said crankshaft, characterized in that said cover member has auxiliary-supporting portion integrally formed thereon to extend radially outwards beyond an outer periphery of said flywheel, and an auxiliary located axially outside said flywheel is supported on said auxiliary-supporting portions.

2. An engine according to claim 1, wherein said auxiliary is a recoil starter coaxially connected to the one end of said crankshaft.

3. An engine according to claim 1, wherein said engine block has an assembling bore for assembling a larger end of a connecting rod at a location opposed to said cylinder bore.

4. An engine according to clam 1, wherein said engine is for an outboard engine system and is at least partly housed in an engine cover of the outboard engine system.

* * * * *